US008905346B2

(12) United States Patent
Repp et al.

(10) Patent No.: US 8,905,346 B2
(45) Date of Patent: Dec. 9, 2014

(54) ROLL UNWINDING DEVICE FOR A WEB PRINTING PRESS

(75) Inventors: Johannes Matthias Rudolf Repp, Erlabrunn (DE); Karl Richard Rösch, Neubrunn (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 14/119,485

(22) PCT Filed: May 25, 2012

(86) PCT No.: PCT/EP2012/059837

§ 371 (c)(1),
(2), (4) Date: Nov. 22, 2013

(87) PCT Pub. No.: WO2013/020729

PCT Pub. Date: Feb. 14, 2013

(65) Prior Publication Data

US 2014/0070044 A1 Mar. 13, 2014

(30) Foreign Application Priority Data

Aug. 9, 2011 (DE) ..... 10 2011 080 654

(51) Int. Cl.
*B65H 19/22* (2006.01)
*B65H 19/12* (2006.01)

(52) U.S. Cl.
CPC ..... *B65H 19/126* (2013.01); *B65H 2402/31* (2013.01); *B65H 2301/413665* (2013.01); *B65H 2511/21* (2013.01)
USPC ..... 242/533.2; 242/533.5; 242/559.2; 242/571

(58) Field of Classification Search
CPC ... B65H 19/126; B65H 75/242; B65H 75/248
USPC ..... 242/533.2, 533.4–533.5, 559.2–559.4, 242/571, 576
See application file for complete search history.

(56) References Cited

U.S. PATENT DOCUMENTS 2,082,031 A 6/1937 Schultz et al.
3,592,403 A * 7/1971 Schmitt et al. ..... 242/527.5
(Continued)

FOREIGN PATENT DOCUMENTS

DE 39 06 506 C2 9/1990
DE 91 05 487.7 U1 8/1991
(Continued)

*Primary Examiner* — Sang Kim
(74) *Attorney, Agent, or Firm* — Mattingly & Malur, PC

(57) ABSTRACT

The invention relates to a roll unwinding device for a web-fed printing machine, wherein the roll unwinding device has at least one roll holding device and at least one drive motor connected to the at least one roll holding device via at least one torque transfer device, and wherein the at least one roll holding device is embodied as a clamping shaft and the clamping shaft has at least one carrier element, which is connected to the clamping shaft so as to be movable at least in a radial direction with respect to a rotational axis of the clamping shaft, and wherein the roll unwinding device has at least two clamping shaft bearings, at least one of which is connected and/or connectable to the clamping shaft so as to transfer and/or be capable of transferring torque, and wherein the at least one clamping shaft bearing is connected to the at least one drive motor via the at least one torque transfer device so as to transfer and/or be capable of transferring torque.

20 Claims, 6 Drawing Sheets

(56) References Cited

U.S. PATENT DOCUMENTS

| | | | | |
|---|---|---|---|---|
| 5,025,998 | A | 6/1991 | Hutzenlaub et al. | |
| 5,060,878 | A | 10/1991 | Hutzenlaub et al. | |
| 5,255,862 | A | 10/1993 | Chenest | |
| 5,370,337 | A | 12/1994 | Pratt | |
| 6,629,665 | B2 * | 10/2003 | Okeyoshi | 242/559.2 |
| 6,679,451 | B1 * | 1/2004 | Biagiotti | 242/559 |
| 2001/0052559 | A1 | 12/2001 | Inana et al. | |
| 2002/0008173 | A1 | 1/2002 | Burri et al. | |
| 2004/0200922 | A1 * | 10/2004 | Nakamura et al. | 242/596.5 |
| 2007/0034727 | A1 | 2/2007 | Kaya | |
| 2010/0188468 | A1 | 7/2010 | Herpel et al. | |

FOREIGN PATENT DOCUMENTS

| | | | |
|---|---|---|---|
| DE | 202 09 571 | U1 | 10/2002 |
| EP | 0 384 988 | A2 | 9/1990 |
| EP | 0 451 698 | A1 | 10/1991 |
| EP | 1 155 987 | B1 | 11/2001 |
| EP | 2 202 081 | A1 | 6/2010 |
| JP | 2003-063707 | A | 3/2003 |

* cited by examiner

ROLL UNWINDING DEVICE FOR A WEB PRINTING PRESS

CROSS REFERENCE TO RELATED APPLICATIONS

This application is the U.S. National Phase, under 35 USC 371, of PCT/EP2012/059837, filed May 25, 2012; published as WO 2013/020729 A1 on Feb. 14, 2013, and claiming priority to DE 10 2011 080 654.7, filed Aug. 9, 2011, the disclosures of which are expressly incorporated herein by reference.

FIELD OF THE INVENTION

The present invention relates to a roll unwinding device for a web-fed printing machine. The roll unwinding device has at least one roll holding device and at least one drive motor connected to the at least one roll holding device via at least one torque transfer element. The at least one roll holding device is embodied as a clamping shaft which has at least one carrier element which is connected to the clamping shaft to be movable, at least in a radial direction, with respect to a rotational axis of the clamping shaft. The roll unwinding device has at least two clamping shaft bearings, at least one of which is connected or can be connected to the clamping shaft to transfer or to be capable of transferring torque. The at least one clamping shaft bearing is connected to the at least one drive motor via at least one torque transfer device to transfer torque or to be capable of transferring torque.

BACKGROUND OF THE INVENTION

Various printing methods that can be used in printing machines are known. One such printing method is inkjet printing or ink-jet printing. In this method, individual droplets of printing ink are ejected from nozzles in print heads and are transferred to a printing material so as to produce a printed image on the printing material. By controlling a plurality of nozzles individually, different printed images can be produced. No set printing forme is used, thus each individual printed product can be designed separately. This allows personalized printed products to be produced and/or, since no printing formes are used, allows small print runs of printed products to be produced at low cost.

The precise alignment of a printed image on the front and back sides of a printing material imprinted on both sides is referred to as register (DIN 16500-2). In multicolor printing, when individual printed images of different colors are combined in precise alignment to form a single image, this is referred to as color registration (DIN 16500-2). In inkjet printing, suitable measures must also be implemented to maintain color registration and/or register.

EP 2 202 081 A1 and JP 2003-063737 A each disclose a printing machine in which the printing machine comprises a first printing unit and a dryer, wherein the first printing unit has a central cylinder with an integral drive motor dedicated to the first central cylinder, and at least one inkjet print head aligned toward an outer cylinder surface of the first central cylinder.

From EP 1 155 987 B1, a roll unwinding device for a web-fed rotary printing machine is known, wherein the roll unwinding device has at least one roll holding device and at least one drive motor, connected to the at least one roll holding device via at least one torque transfer device.

From EP 0 384 988 A2, a roll unwinding device having at least one roll holding device is known.

From DE 39 06 506 C2, a roll unwinding device is known, which has at least one roll holding device and at least one drive motor connected to the at least one roll holding device via at least one torque transfer device.

DE 91 05 487 U1 and EP 0 451 698 A1 each disclose a clamping shaft bearing embodied as a bearing cap.

US 2007/034727 A1, U.S. Pat. No. 5,370,337 A and U.S. Pat. No. 5,255,862 A each disclose a roll unwinding device which has at least one roll holding device and at least one drive motor connected to the at least one roll holding device via at least one torque transfer device, wherein the at least one roll holding device is embodied as a clamping shaft, and wherein the clamping shaft has at least one carrier element, which is connected to the clamping shaft so as to be movable at least in a radial direction with respect to a rotational axis of the clamping shaft, and wherein the roll unwinding device has at least two clamping shaft bearings, at least one of which is connected and/or connectable to the clamping shaft so as to transfer and/or be capable of transferring torque, and wherein the at least one clamping shaft bearing is connected to the at least one drive motor via the at least one torque transfer device so as to transfer and/or be capable of transferring torque.

From EP 0 451 698 A1 a bearing cap of a roll unwinding device is known. A drive for the roll unwinding device and carrier elements are mentioned.

From U.S. Pat. No. 2,082,031 A a roll winding device is known, in which paper is wound onto an expandable core, without inserting a core tube. Drive means and carrier elements are disclosed.

From US 2001 052559 A1 a roll unwinding device is known, which has at least one roll holding device and at least one drive motor connected to the at least one roll holding device via at least one torque transfer device, wherein the at least one roll holding device is embodied as a clamping shaft.

From DE 202 09 571 U1, a roll unwinding device for a packaging machine is known, wherein the roll unwinding device has at least one roll holding device, and wherein at least two roller bearings are arranged at least partially rotatable around a rotational axis, and as pivotable relative to a frame of the roll unwinding device around a pivot axis that is different from the rotational axis.

SUMMARY OF THE INVENTION

The object of the invention is to devise a roll unwinding device for a web-fed printing machine.

The object is attained according to the invention by the provision of the at least two clamping shaft bearings as being arranged to rotate, at least partially, around a rotational axis of the clamping shaft, and so as to pivot relative to a frame of the roll unwinding device around a pivot axis that is different from the rotational axis. The at least two clamping shaft bearings are embodied as bearing caps.

The advantages to be achieved by the invention consist particularly in that the roll unwinding device can be produced cost-effectively and operated easily. The arrangement of at least one clamping shaft and two clamping shaft bearings allows rolls of printing material to be loaded particularly rapidly and with low susceptibility to error. At the same time, said arrangement offers great flexibility with respect to the format of the printing material roll. Moreover, preferred variants in which the clamping shaft bearings are pivotable about a pivot axis offer the advantage that rolls of printing material can be loaded and/or residual rolls or empty cores unloaded, particularly easily, safely and rapidly. Preferred variants in which a drive motor can also be pivoted offer advantages in terms of particularly favorable drive conditions and/or weight distribution. Preferred variants in which a pivoting range is limited offer the advantage of a particularly simple, malfunction-resistant and cost-effective supply of power to the drive motor. A preferred arrangement of a dancer lever and/or a dancer roller and/or a web edge aligner and/or an infeed unit comprising an infeed nip, formed by a traction roller and a traction impression roller, and a measuring roller offers the advantage that a printing material web that is unwound by means of the roll unwinding device is aligned and clamped particularly evenly and in a particularly defined manner, and is therefore provided for further processing under particularly advantageous conditions.

BRIEF DESCRIPTION OF THE DRAWINGS

Examples of variants of the invention are illustrated in the set of drawings and will be specified in greater detail in the following.

The drawings show.

DESCRIPTION OF THE PREFERRED EMBODIMENT

Figure 1:
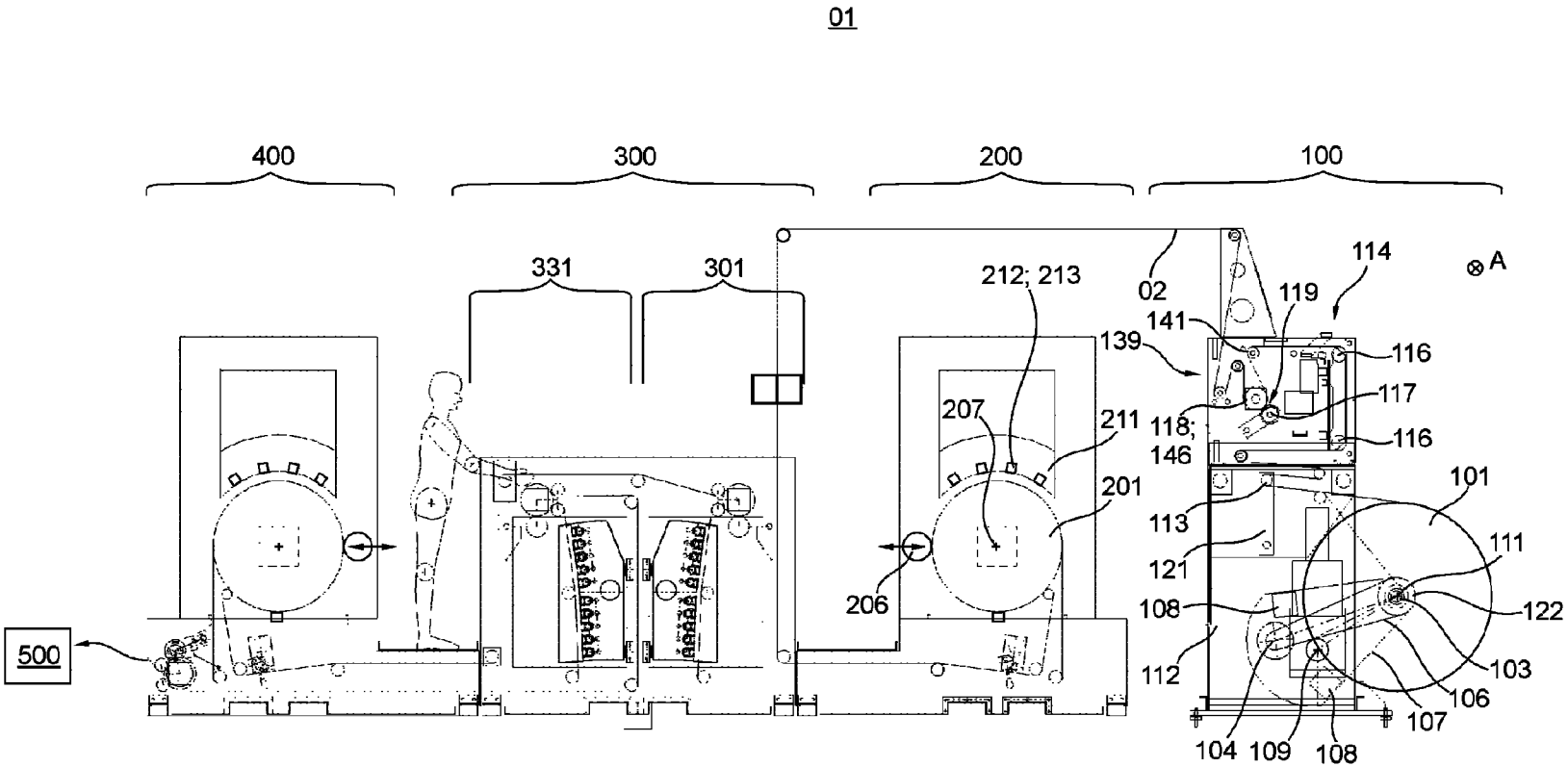
FIG. 1 a schematic illustration of a web-fed printing machine.
Figure 2:
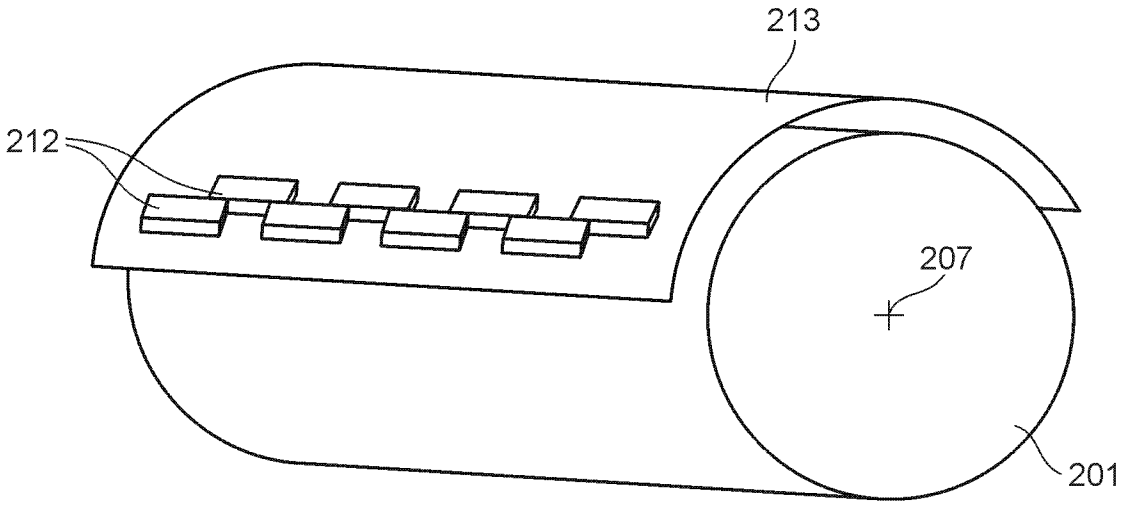
FIG. 2 a schematic illustration of part of a printing unit having a double row of print heads.
Figure 3:
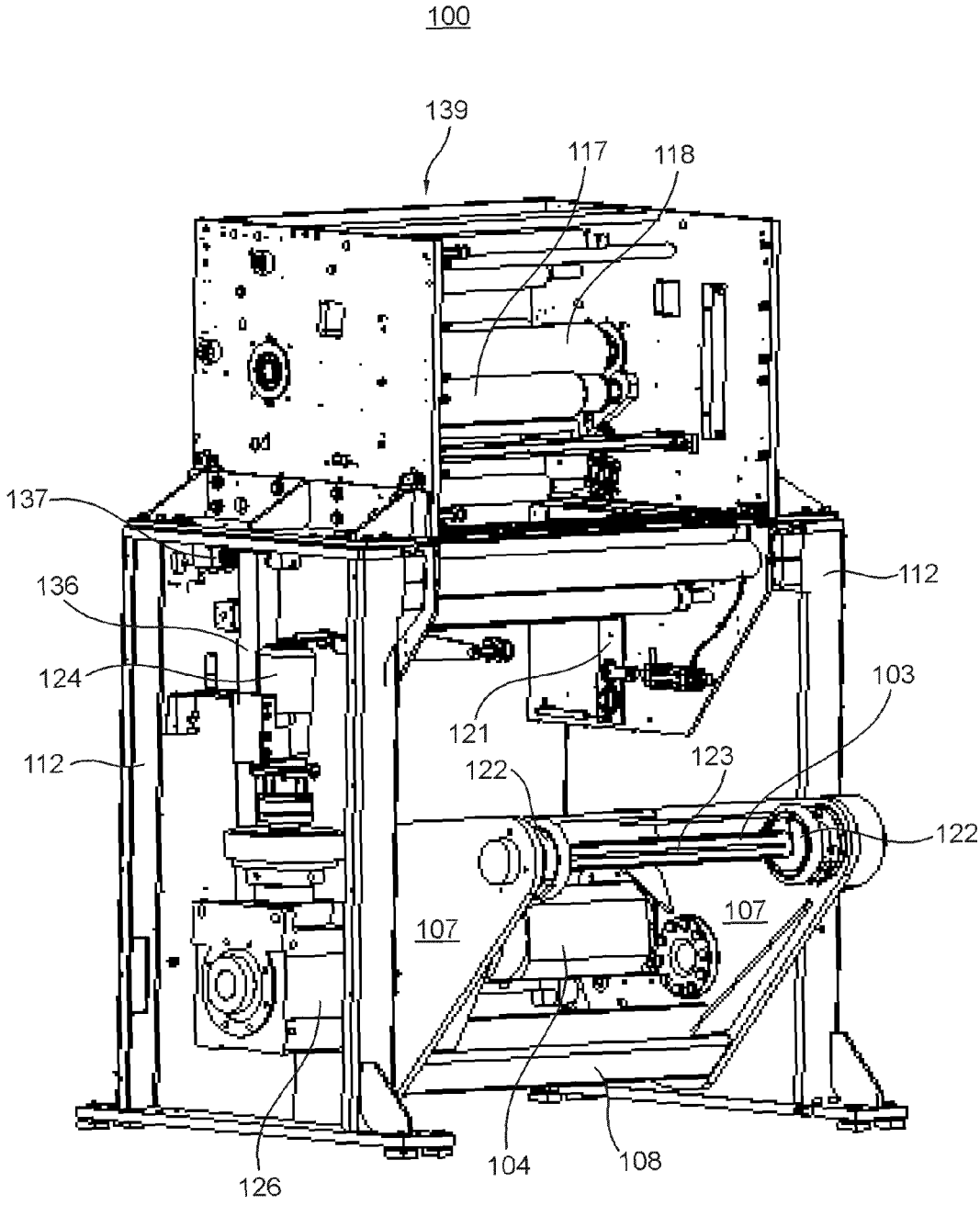
FIG. 3 a schematic illustration of a roll unwinding device.
Figure 4:
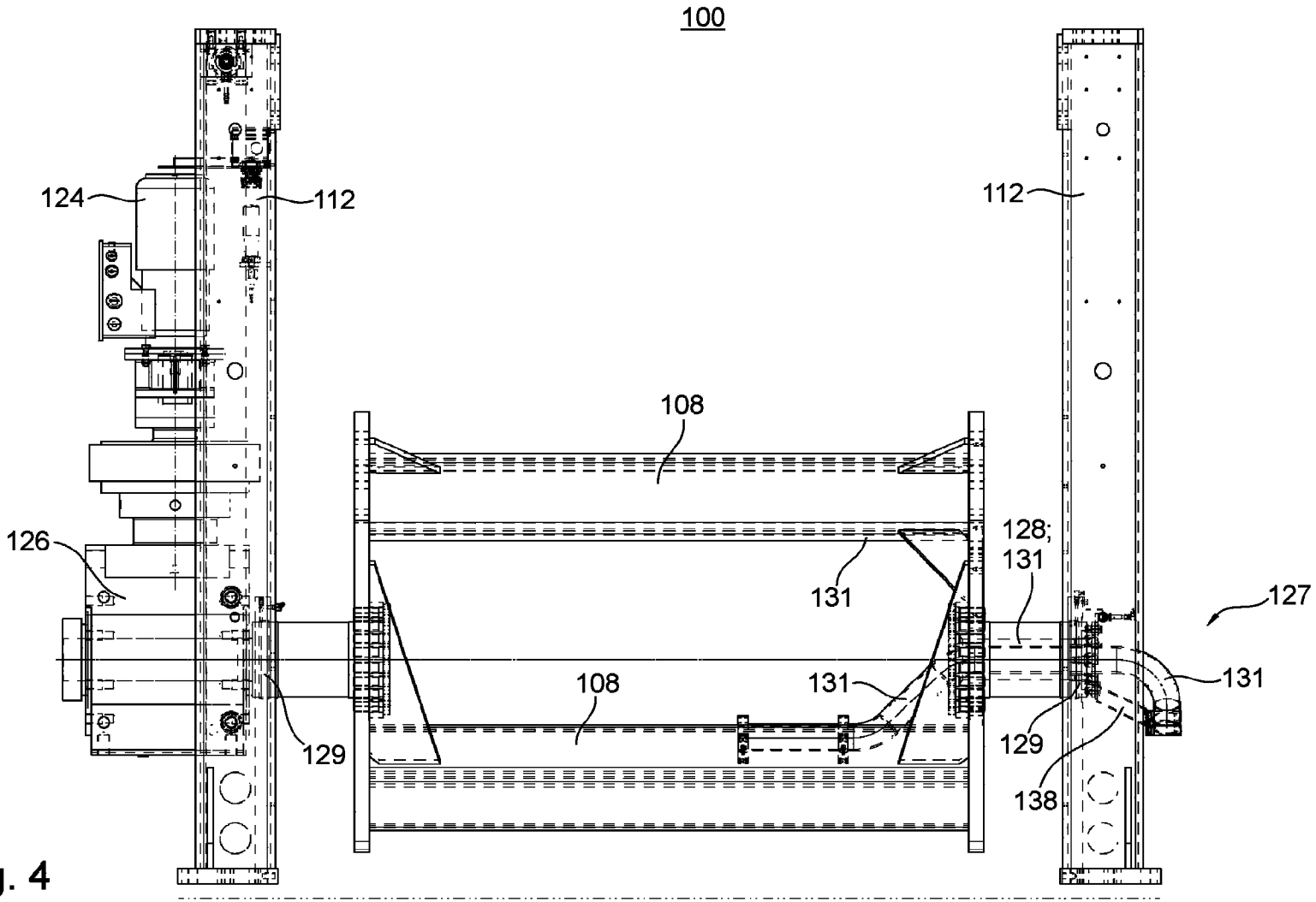
FIG. 4 a schematic illustration of part of a roll unwinding device.
Figure 5:
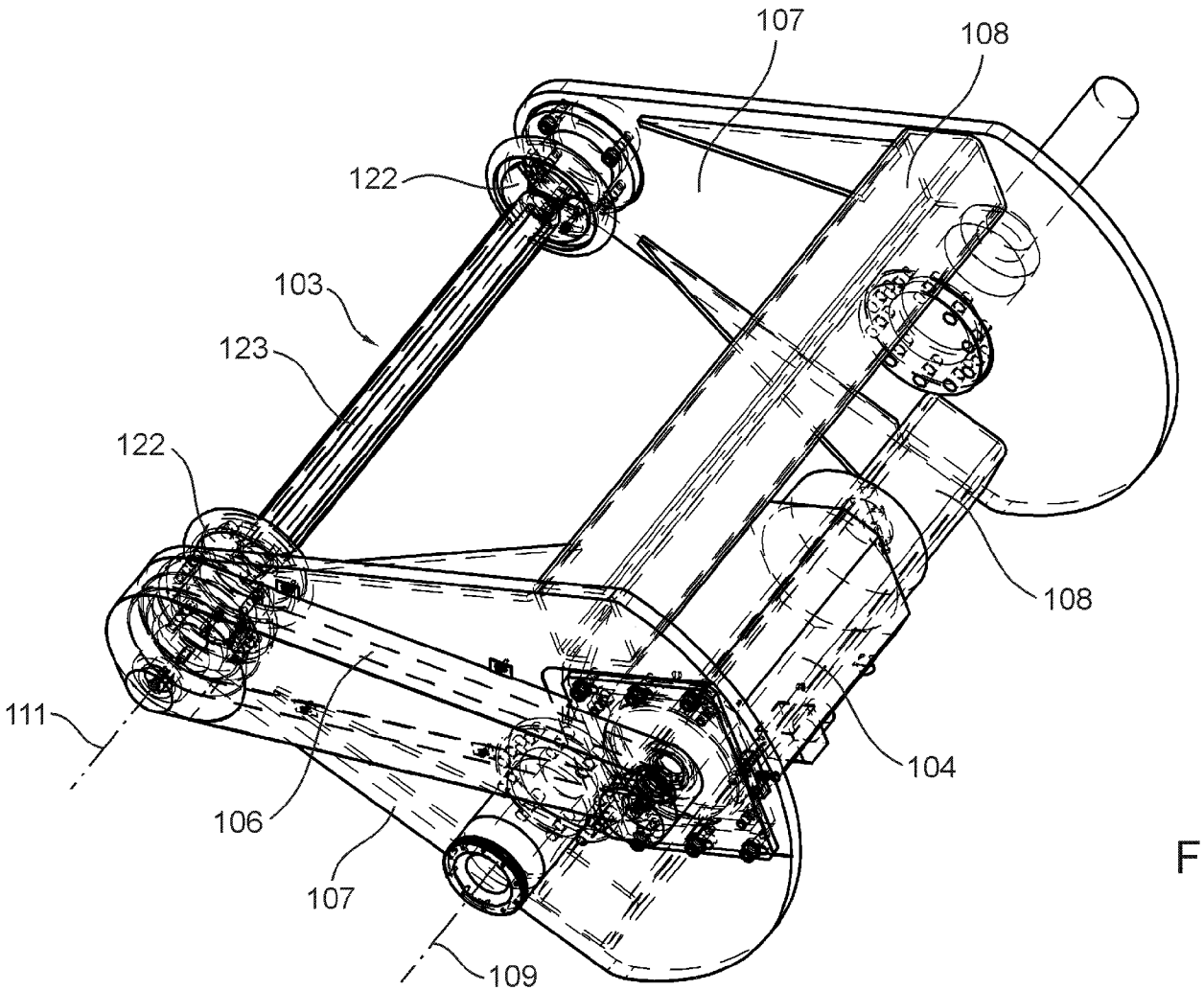
FIG. 5 a schematic illustration of a support frame of a roll unwinding device.
Figure 6:
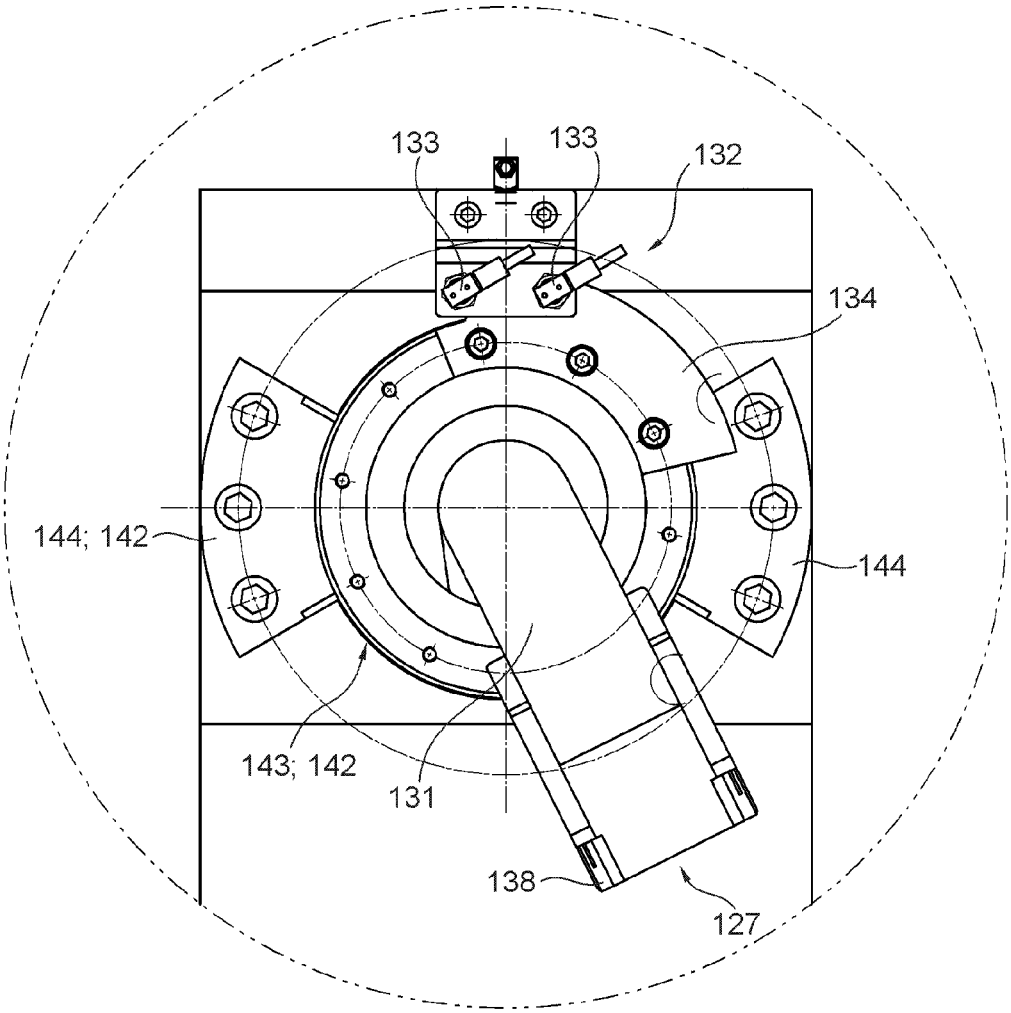
FIG. 6 a schematic illustration of an infeed device of a roll unwinding device.

A printing machine 01 embodied, for example, as a rotary printing machine 01 has at least one printing material source 100, at least one first printing unit 200, preferably at least one first dryer 301, preferably at least one second printing unit 400 and preferably at least one second dryer 331 and at least one post-processing apparatus 500. Moreover, the printing machine 01 is preferably embodied as an inkjet printing machine 01. The printing machine 01 is preferably embodied as a web-fed printing machine 01, more preferably as a web-fed inkjet printing machine 01. The printing machine 01 is embodied, for example, as a rotary printing machine 01, for example, as a web-fed rotary printing machine 01, particularly as a web-fed rotary inkjet printing machine 01. In the case of a web-fed printing machine 01, the printing material source 100 is embodied as a roll unwinding device 100. In the case of a sheet-fed printing machine or a sheet-fed rotary printing machine, the printing material source 100 is embodied as a sheet feeder. In the printing material source 100, printing material 02 is aligned, preferably with respect to at least with respect to one edge of the printing material 02. In the roll unwinding device 100 of a web-fed printing machine 01, a web-type printing material 02, that is, a printing material web 02, for example, a paper web 02 or a textile web 02 or a film 02, for example, a plastic film 02 or a metal film 02, is unwound from a printing material roll 101 and is preferably aligned with respect to its edges. The printing material 02 and particularly the printing material web 02 is then guided through the at least one first printing unit 200, where the printing material 02 and particularly the printing material web 02 is provided with a printed image at least on one side and preferably on two sides using at least one printing ink.

After passing through the at least one first printing unit 200, the printing material 02 and particularly the printing material web 02 preferably passes through the at least one first dryer 301 in order to dry the printing ink that has been applied. Printing ink in the above and in what follows is generally understood as a coating agent, particularly including a varnish. The at least one first dryer 301 is preferably a component of a dryer unit 300. After passing through the at least one first dryer 301 and preferably the at least one second printing unit 400 and/or the at least one second dryer 331, the printing material 02 and particularly the printing material web 02 is preferably fed to the at least one post-processing apparatus 500, where it is further processed. The at least one post-processing apparatus 500 is embodied, for example, as at least one folding device 500 and/or as a winding device 500. In the at least one folding device 500, the printing material 02, which has preferably been imprinted on two sides, is further processed to produce individual printed products. More particularly, this means that preferably at least the first dryer 301, preferably followed by at least the second printing unit 400, and preferably followed by the at least one second dryer 331 are arranged downstream of the at least one first printing unit 200 along a transport path of the printing material 02 and particularly of the printing material web 02 through the printing machine 01. This serves to ensure a high-quality, two-sided printing of the printing material 02 and particularly of the printing material web 02.

In what follows, a web-fed printing machine 01 will be described in greater detail. However, relevant details may also be transferred to other printing machines 01, for example, sheet-fed printing machines, as long as no incompatibilities exist. Printing material rolls 101 which are preferably used in the roll unwinding device 100 preferably each have a core onto which the web-type printing material 02 is wound for use in the web-fed printing machine 01. The printing material web 02 preferably has a width of 700 mm to 900 mm, but may also have any smaller or preferably larger width. At least one printing material roll 101 is rotatably arranged in the roll unwinding device 100. In a preferred variant, the roll unwinding device 100 is suitably embodied for receiving one printing material roll 101, and thus has only one storage position for a printing material roll 101. In another variant, the roll unwinding device 100 is embodied as a roll changer 100 and has storage positions for at least two printing material rolls 101 and preferably enables a flying roll change, that is, a connection of a first printing material web 02 of a printing material roll 101 currently being processed to a second printing material web 02 of a printing material roll 101 that will subsequently be processed, while both the printing material roll 101 currently being processed and the printing material roll 101 that will subsequently be processed are rotating.

The roll unwinding device 100 preferably has at least one roll holding device 103, embodied as a chucking device 103 and/or as a clamping device 103, for example, per storage position. The at least one roll holding device 103 is used for rotatably mounting at least one printing material roll 101. The at least one roll holding device 103 is preferably in contact with the core of the printing material roll 101. A clamping device 103 in this case is a roll holding device 103 in which contact which transfers and/or is capable of transferring torque is produced between the clamping device 103 and the printing material roll 101 in that, as a result of a movement of the clamping device 103 and the printing material roll 101 relative to one another in the axial direction A, referred to the printing material roll 101, contact which is sufficient for transferring torque is produced between the printing material roll 101 and the clamping device 103. Such contact is produced, for example, by the clamping device 103 being pressed far enough in the axial direction A against the printing material roll 101 and particularly the core thereof, and/or by the clamping device 103 cutting at least partially into the core of the printing material roll 101 as a result of relative movement in the axial direction A, and/or by the clamping device 103 being connected in an interlocking fashion to the printing material roll 101 with respect to movement in the circumferential direction, solely as a result of movement in the axial direction A relative to the printing material roll 101. Such a clamping device 103 can be in the form of two clamping mandrels 103 or clamping cones 103, for example, at least one of which is arranged displaceably in the axial direction A.

A chucking device 103 in this case is a roll holding device 103 in which contact which transfers and/or is capable of transferring torque is produced between the chucking device 103 and the printing material roll 101, in that, once the chucking device 103 has been inserted at least partially into an opening in the printing material roll 101, at least one component of the chucking device 103, for example, at least one carrier element embodied as a clamping jaw, is moved relative to the remainder of the chucking device 103 and relative to the printing material roll 101 in a direction at least having a component in a radial direction with respect to the printing material roll 101, until a force-fitted and/or interlocking connection between the chucking device 103 and the printing material roll 101 is produced. The at least one chucking device 103 is preferably embodied as two chucking mandrels 103 or chucking cones 103, or more preferably as a clamping shaft 103. The clamping shaft 103 in this case is a component of the roll unwinding device 100 that is different from the core of a printing material roll 101. In at least one operating state, the clamping shaft 103 preferably extends from one clamping shaft bearing 122 of the roll unwinding device 100 to another clamping shaft bearing 122 of the roll unwinding device 100. In at least one operating state, the at least one clamping shaft 103 is preferably in contact with a core of a printing material roll 101 and more preferably extends continuously through an opening in the core of the printing material roll 101. The clamping shaft 103 is preferably at least partially encompassed by clamping shaft bearings 122, particularly at its axial ends, in at least one radial direction with respect to the rotational axis 111 of the clamping shaft 103.

The at least one roll holding device 103 preferably has at least one drive motor 104, and preferably can be and/or is rotationally driven by this at least one drive motor 104, or by one drive motor each. Thus the roll unwinding device 100 particularly has at least one drive motor 104. The at least one drive motor 104 is preferably embodied as at least one electric motor 104 and more preferably as at least one position-controlled electric motor 104. The at least one drive motor 104 is preferably the sole controllable component of the roll unwinding device 100 by means of which a selective acceleration or deceleration of a rotation of the clamping shaft 103 about the rotational axis 111 thereof can be executed. A drive controller of the at least one drive motor 104 is preferably provided. This drive controller is preferably embodied for various operating modes.

A first operating mode involves accelerating the printing material roll 101 and holding it at a substantially constant rotational speed. This is the case, for example, during a printing operation of the printing machine 01. A second operating mode involves operating the drive motor 104 in generator operation. In this case, the drive motor 104 is controlled by the drive controller so as to decelerate the rotation of the printing material roll 101, producing electrical energy. Thus rotational energy is converted to electrical energy and is stored in a main power network and/or an electrical energy storage device, for example. A third operating mode involves modifying a phase position of the drive motor 104 actuation to a more or less opposite phase actuation of the at least one drive motor 104. In this mode, electrical energy is expended to actively decelerate the rotation of the printing material roll 101. This is the case, for example, when, in the event of an emergency, it is necessary to stop the printing machine 01 as quickly as possible. Such an operating mode is also known as plug braking. It is also conceivable to provide multiple drive motors 104 and to operate some of the drive motors 104 in generator operation, and to use the electrical energy thereby obtained for the opposite phase actuation of others of the drive motors 104. Greater emphasis can thereby be placed on a rapid or an energy-saving deceleration and/or stoppage of the printing material roll 101, depending on requirements.

In the case of chucking mandrels 103 or clamping mandrels 103, this at least one drive motor 104 of the at least one roll holding device 103 is preferably connected via at least one torque transfer device 106, preferably a traction means 106, for example, a belt 106 and preferably a toothed belt 106, to the respective clamping mandrel(s) 103 or chucking mandrel(s) 103. The torque transfer device 106 can also be embodied, for example, as at least one gear wheel 106. However, a belt 106 or a chain 106 offers advantages in terms of weight, and usually has a lower mass, which helps to conserve energy during accelerations. In the case of a clamping shaft 103, this at least one drive motor 104 of the clamping shaft 103 is preferably connected to at least one clamping shaft bearing 122 via the at least one torque transfer device 106, embodied, for example, as at least one gear wheel 106 and preferably as at least one traction means 106, for example, as a chain 106 or a belt 106, and more preferably as at least one toothed belt 106, in such a manner as to transfer and/or be capable of transferring torque.

The at least one roll holding device 103 and/or the drive motor 104 or drive motors 104 thereof are preferably each connected via at least one supporting arm 107 to a preferably common axle 108 or at least one common support 108 or support frame 108, around which or with which all existing storage positions are rotatably and/or pivotably arranged. This allows the at least one printing material roll 101 to be adjusted with respect to the position of its rotational axis 111 and its outer surface during a mounting of the at least one printing material roll 101 in the roll unwinding device 100 and/or during a removal of a residual core or residual printing material roll 101 from the roll unwinding device 100 and/or during a flying roll change and/or during an ongoing printing operation with a decreasing roll diameter. The drive motor 104 is preferably connected to the printing material roll 101, preferably solely via the corresponding roll holding device 103, and more particularly, is not connected via a belt to an outer cylinder surface of the printing material roll 101.

A first, preferred variant of the roll unwinding device 100 will first be described, in which two clamping shaft bearings 122 and one clamping shaft 103 are provided at each storage position. However, all specifications may be transferred accordingly to a variant of the roll holding device 103 as a chucking device 103 in general or as a clamping device 103, as long as no incompatibilities exist. The at least one and preferably precisely one storage position preferably has two supporting arms 107, each of which has one clamping shaft bearing 122, preferably embodied as a bearing cap 122. The roll unwinding device 100 thus preferably has precisely two supporting arms 107. At least one clamping shaft bearing 122 is connected and/or connectable to the clamping shaft 103 so as to transfer and/or be capable of transferring torque. At least one clamping shaft bearing 122 has a closure element, which in the case of a bearing cap 122 is preferably pivotable about a closure axis. The closure axis preferably has at least one component which is aligned orthogonally to the rotational axis 111 of the clamping shaft 103. As a result of this feature, when the clamping shaft 103 arranged in the bearing caps 122 rotates, there is no danger of the bearing cap 122 opening as a result of this rotation. The respective clamping shaft bearing 122 is opened and/or closed by pivoting the closure element. To load a printing material roll 101, the clamping shaft bearings 122 of the two supporting arms 107 are opened. A clamping shaft 103 is guided through an opening in the core of the printing material roll 101 so that an axial end of the clamping shaft 103 projects out of the core of the printing material roll 101 at each axial end of the core of the printing material roll 101. The clamping shaft 103 preferably has at least one carrier element 123, preferably embodied as a clamping jaw 123, and more preferably has at least two carrier elements 123, preferably embodied as clamping jaws 123. The clamping shaft 103 further forms a continuous supporting journal, to which the carrier elements 123, preferably embodied as clamping jaws 123, are preferably movably connected.

The carrier elements 123, preferably embodied as clamping jaws 123, are connected to the clamping shaft 103 such that their position can be adjusted, preferably at least in a radial direction with respect to a rotational axis 111 of the clamping shaft 103, which coincides with the rotational axis 111 of the printing material roll 101, regardless of the number of carrier elements present. When the carrier elements 123 preferably embodied as clamping jaws 123 are in a freely operating state, all the components of the carrier elements 123 preferably embodied as clamping jaws 123 lie within a radius that is defined by a maximum radial dimension of the supporting journal. When the carrier elements 123 preferably embodied as clamping jaws 123 are in a clamped operating state, parts of the carrier elements 123 preferably embodied as clamping jaws 123 lie outside of this radius. The carrier elements 123 preferably embodied as clamping jaws 123 are preferably movable by means of a pneumatic system. The pneumatic system preferably operates against the spring force of at least one provided spring, wherein the spring force is preferably embodied as forcing the carrier elements 123 preferably embodied as clamping jaws 123 into the freely operating state. The carrier elements 123 preferably embodied as clamping jaws 123 are then moved to the clamped operating state by means of at least one pneumatic device connected to a pneumatic port. The clamped operating state is durably secured via at least one valve, which is part of the pneumatic system, or is transferred to the freely operating state by opening said valve. In the clamped operating state, the clamping shaft 103 is non-rotatably connected to the core of the printing material roll 101 so as to transfer and/or be capable of transferring torque.

The clamping shaft 103, together with the printing material roll 101, is placed with its two ends in the two clamping shaft bearings 122. The two clamping shaft bearings 122 are then each closed, preferably by pivoting the closure elements to a closed position. A locking device for each of the clamping shaft bearings 122 is likewise preferably closed, for example, by snap-locking a spring-mounted securing journal into a corresponding recess, or by rotating a hand wheel to a corresponding position. Once the clamping shaft bearings 122 have been closed, the clamping shaft bearings 122 are connected to the clamping shaft 103 so as to transfer and/or be capable of transferring torque. The clamping shaft 103 is preferably installed in the clamping shaft bearings 122 by inserting the clamping shaft 103 in a direction having a vertically downward oriented component into the clamping shaft bearings 122, for example, lowering it by means of a crane or a lift carriage, for example, and/or by moving the clamping shaft bearings 122, preferably together with respective supporting arms 107, in a direction having a vertically upward oriented component, causing the bearings to receive the clamping shaft 103 and, more preferably, to raise the clamping shaft 103 together with the printing material roll 101. For this purpose, the printing material roll 101 together with the clamping shaft 103 is first moved to a corresponding receiving position. This is accomplished, for example, by rolling the printing material roll 101 or with the help of a transport means, for example a lifting carriage or a transport carriage of a fixedly arranged transport system, which is partially recessed into the floor, for example. A suitable, particularly centered positioning of the printing material roll 101 relative to the clamping shaft 103 results in a roll unwinding device 100 that is suitable for all web widths up to a maximum web width. More particularly, this allows different web widths to be processed without adjusting the roll unwinding device 100. In the opened state, the clamping shaft bearings 122 each have an opening angle of preferably between 40° and 80°. This opening angle is an angle that lies in a plane to which the rotational axis 111 of the clamping shaft 103 is orthogonally oriented. More preferably, the clamping shaft bearings 122 have a permissible angular position range for opening the clamping shaft bearings 122 of preferably between 5° and 90° and more preferably between 40° and 80°. This angular position range is an angle that lies in a plane to which the rotational axis 111 of the clamping shaft 103 is orthogonally oriented. Only when the respective clamping shaft bearing 122 is located in a rotational angle position that lies within this permissible angular position range can the respective clamping shaft bearing 122 be opened. If the respective clamping shaft bearing 122 is in a rotational angle position that lies outside of this permissible angular position range, it will close automatically and/or cannot be opened.

Each of the two clamping shaft bearings 122 is preferably connected via one supporting arm 107 each to the at least one common support 108 or support frame 108. The two supporting arms 107 and the at least one common support 108 or support frame 108 are preferably embodied as a single component. The two supporting arms 107 and the at least one common support 108 or support frame 108, and therefore preferably also the at least two clamping shaft bearings 122, are arranged so as to pivot around a pivot axis 109, particularly relative to a preferably stationary frame 112 of the roll unwinding device 100. The pivot axis 109 is different from the rotational axis 111 of the clamping shaft 103, but is preferably arranged parallel thereto. To this end, the at least one common support 108 or support frame 108 is mounted at two ends referred to the axial direction A, each end in at least one bearing 129. The at least one bearing 129 is preferably embodied as a roller bearing 129 and/or as a plain bearing 129. As a result of pivoting movements of the supporting arms 107 and of the at least one common support 108 or support frame 108, a printing material roll 101 is loaded and/or the position thereof is adjusted and/or released, or the position of the supporting arms 107 and the at least one common support 108 or support frame 108 is aligned, for example, in preparation for loading a printing material roll 101. More particularly, the at least one common support 108 or support frame 108 and the clamping shaft bearings 122 and the roll holding device 103 are preferably pivotable about the same pivot axis 109.

At least one pivot drive 124 is preferably positioned so as to effect and/or be capable of effecting a pivoting movement of the at least one common support 108 or support frame 108 relative to the frame 112 of the roll unwinding device 100. To receive and/or to release a printing material roll 101 by means of the roll unwinding device 100, the two supporting arms 107 and the at least one common support 108 or support frame 108 are preferably manually or automatically moved to least one suitable pivoted position, preferably on the basis of a diameter of the printing material roll 101. In the case of manual operation, this is preferably accomplished gradually and under visual monitoring by an operator. In the case of automated operation, at least one sensor, for example, an optical and/or acoustic and/or inductive sensor, for example, a laser sensor and/or an ultrasound sensor, is preferably provided, which determines the diameter of the printing material roll 101 and passes this on to a machine controller, which then moves the two supporting arms 107 and the at least one common support 108 or support frame 108 to a suitable pivoted position. During printing operation, the diameter of the printing material roll 101 is determined, at least as needed, from the angular velocity of the printing material roll 101 and the transport speed of the printing material web 02.

The roll unwinding device 100 preferably has precisely one storage position for precisely one printing material roll 101. Therefore, it is not necessary for the at least one common support 108 or support frame 108 to be capable of executing multiple revolutions, as would be necessary, for example, in the case of multiple successive flying roll changes. The at least one common support 108 or support frame 108 is pivotable about the pivot axis 109 by an angle measuring preferably less than 360°, and more preferably less than 180°, and more preferably still less than 80°. The angle preferably measures at least 20° and more preferably at least 45°. This allows printing material rolls 101 of different diameters to be processed. This angle is determined by the ends of a pivoting range, the dimensions of which are preferably such that the at least one common support 108 or support frame 108 can receive and/or discharge paper rolls having a diameter of 400 mm or less and/or even empty cores on the floor and/or from a storage surface, for example a pallet, and such that a printing material roll 101 up to a maximum diameter can always be held in an unwinding position that corresponds to a current diameter. To limit the pivoting range, a pivoting range limiter 132 is preferably provided. In a preferred variant of the pivoting range limiter 132, the pivoting range limiter 132 has at least one position sensor 133, for example, at least one optical and/or acoustic and/or inductive position sensor 133. The pivoting range limiter 132 preferably has at least one reference component 134, which more preferably is detected and/or detectable by the at least one position sensor 133.

In a preferred variant, the pivoting range limiter 132 has two position sensors 133, preferably embodied as inductive position sensors 133, and the pivoting range limiter 132 has a reference component 134, preferably embodied as segment-shaped. The reference component 134 is preferably arranged rigidly in relation to the at least one common support 108 or support frame 108, whereas the at least one position sensor 133 is preferably arranged rigidly in relation to the frame 112 of the roll unwinding device 100. This serves to facilitate the supply of electric power to the at least one position sensor 133, for example. The corresponding dimensioning of the reference component 134 and the corresponding arrangement of the reference component 134 and the position sensors 133 relative to one another ensure that the two end positions of the pivoting range can be detected. In another variant, a rotational angle sensor is provided, the signals of which are transmitted to a machine controller. The machine controller then decides on the basis of stored data whether an end of a permissible pivoting range has been reached.

In a first, preferred variant of the pivot drive 124, the pivot drive 124 is embodied as at least one electric motor 124, the rotor of which is connected, directly or with the interconnection of torque transfer elements, to the at least one common support 108 or support frame 108 so as to transfer and/or be capable of transferring torque. The rotor of the at least one electric motor 124 is preferably connected via at least one bevel gear system 126 to the at least one common support 108 or support frame 108 so as to transfer and/or be capable of transferring torque. This results in a space-saving configuration. A corresponding transmission is preferably provided in order to synchronize the requirements of the electric motor 124 with those of the at least one common support 108 or support frame 108. A stator and/or a housing of the pivot drive 124 is preferably arranged non-rotatably, or more preferably supported via a torque support 136, on the frame 112 of the roll unwinding device 100. The torque support 136 is in contact with the frame 112 of the roll unwinding device 100, at least at one contact point, directly or preferably via at least one torque limiter 137. Providing the torque support 136 and dispensing with a rigid arrangement of the stator of the electric motor 124 on the frame 112 of the roll unwinding device 100 allows strains within the bevel gear system 126 and/or the electric motor 124 to be avoided, which otherwise might be caused, for example, by a deflection of the at least one common support 108 or support frame 108.

The torque limiter 137 preferably has at least one torque sensor, which consists of a spring package and an initiator, for example. When a maximum permissible torque is exceeded, the spring package is compressed via a corresponding deflection of the torque support 136 until the initiator registers that a maximum permissible deflection of the torque support 136 has been reached. In response to a corresponding signal from this torque sensor, the pivot drive 124 is then switched off. This serves to ensure that the preferably manually controlled pivot drive 124 will not become damaged and/or cause damage as a result of improper operation. With a corresponding configuration of a torque limiter 137 or arrangement of two torque limiters 137, both possible pivot directions are protected. For emergencies, the electric motor 124 preferably has a connection for a crank handle, which is covered by a sensor-monitored cover. When the sensor-monitored cover is open, the electric motor 124 can be operated only manually.

At least one position limiter 142 is preferably provided, which holds the axial movement of the at least one common support 108 or support frame 108 within limits, or preferably prevents such movement substantially, and more preferably prevents such movement entirely. The position limiter 142 preferably has at least one annular groove 143 and at least one stop 144 arranged at least partially in the annular groove 143. The at least one annular groove 143 is preferably arranged rigidly in relation to the at least one common support 108 or support frame 108, and the at least one stop 144 is preferably arranged rigidly in relation to the frame 112 of the roll unwinding device 100. The at least one reference component 134 of the pivoting range limiter 132 is preferably rigidly connected to a component of the position limiter 142, or is part of said position limiter 142. This allows multiple components, all of which serve to align the at least one common support 108 or support frame 108 and/or to adjust a permissible range of motion of the at least one common support 108 or support frame 108, to be readily accessed simultaneously.

In a second variant of the pivot drive 124, the pivot drive 124 is embodied as at least one hydraulic cylinder 124, which is supported against the frame 112 of the roll unwinding device 100 at one end and against the at least one common support 108 or support frame 108 at the other end. In a third variant of the pivot drive 124, the pivot drive 124 is embodied as at least one electric lifting cylinder drive 124, which is supported against the frame 112 of the roll unwinding device 100 at one end and against the at least one common support 108 or support frame 108 at the other end. Such an electric lifting cylinder drive 124 has at least one electric motor and at least one threaded spindle, preferably embodied as a trapezoidal threaded spindle, connected to the electric motor so as to transfer and/or be capable of transferring torque. The threaded spindle is further engaged with a threaded nut, which is connected via a corresponding bearing to the at least one common support 108 or support frame 108. The connection of threaded spindle and threaded nut is preferably self-locking and is therefore particularly well suited to this application. The second and third variants of the pivot drive 124 also preferably have at least one torque limiter 137, which can be embodied as a slip clutch and/or as at least one end position sensor, for example, in the case of the electric lifting cylinder drive 124.

Regardless of the variant of the pivot drive 124, the drive motor 104 of the at least one roll holding device 103, which effects and/or accelerates and/or decelerates and/or maintains a rotation of the printing material roll 101 about the rotational axis 111 thereof, preferably via the at least one torque transfer element 106, is rigidly positioned on the at least one common support 108 or support frame 108. At least one stator of this drive motor 104 is preferably arranged rigidly on the at least one common support 108 or support frame 108. Therefore, the drive motor 104 is arranged so as to pivot together with the at least one common support 108 or support frame 108 about the pivot axis 109. This means that when the at least one common support 108 or support frame 108 executes a pivoting movement, induced, for example, by the pivot drive 124, the drive motor 104 is pivoted along with it. A constant position of the drive motor 104 relative to the printing material roll 101 and relative to the storage position thereof is thereby ensured. This results in constant operating conditions for the drive motor 104 and for the torque transfer element 106, particularly a belt 106, preferably connected thereto. A plane that contains the entire pivot axis 109 and extends in a vertical direction preferably separates the rotational axis 111 of the clamping shaft 103 from the rotational axis of the drive motor 104 at all times and in every operationally permissible angular position of the at least one common support 108 or support frame 108, that is, particularly independently of the angular position of the at least one common support 108 or support frame 108. This results in an advantageous distribution of weight, since the weights of drive motor 104 and printing material roll 101 are aligned so as to produce opposing torques.

At least one infeed device 127 is preferably arranged on at least one side of the frame 112 of the roll unwinding device 100, referred to the axial direction A. This at least one infeed device 127 serves to supply the drive motor 104 and/or other components rigidly disposed on the at least one common support 108 or support frame 108 with power and/or with cooling fluid and/or with compressed air and/or with hydraulic fluid. This infeed device 127 is preferably dedicated to a bearing 129 of the at least one common support 108 or support frame 108. The infeed device 127 preferably has at least one feed-through 128, more preferably embodied as an opening 128. The pivot axis 109 of the at least one common support 108 or common support frame 108 of the roll unwinding device 100 extends through this opening 128. This means, particularly, that a straight line extending along the pivot axis 109 of the at least one common support 108 or common support frame 108 through the bearing 129 to which the infeed device 127 is assigned is free of components of this bearing 129 to which the infeed device 127 is assigned. The opening 128 preferably has a circular cross-section and/or extends, at least in sections, coaxially to the pivot axis 109 of the at least one common support 108 or support frame 108. The bearing 129 to which the infeed device 127 is assigned preferably has an outer ring, non-rotatably connected to the frame 112 of the roll unwinding device 100, and preferably has an inner ring, non-rotatably connected to the at least one common support 108 or support frame 108. The outer ring preferably has an inner diameter that is at least equal to and preferably greater than the outer diameter of the inner ring. The opening 128 preferably extends through the inner ring and through the outer ring. The infeed device 127 preferably has a tubular component 131, which lines the opening 128. This tubular component 131 is preferably made of a plastic material. The tubular component 131 is embodied either as a single component or as a group of components.

At least one line, for example, at least one power supply line and/or at least one fluid supply line, is arranged extending through the opening 128. A first end of the at least one line is rigidly connected to a component which is arranged fixedly in relation to the frame 112 of the roll unwinding device 100, and a second end of the at least one line is rigidly connected to a component which is arranged fixedly in relation to the at least one common support 108 or support frame 108. The at least one line in this case has at least one irreversibly separable component, which extends from the first end of the at least one line up to the second end of the at least one line, and/or has a plurality of irreversibly separable components, which together extend from the first end of the at least one line up to the second end of the at least one line, and are connected to one another in an interlocking and/or force-fitted connection. This means that the at least one line can be severed between its first end and its second end only by separating at least one interlocking and/or force-fitted connection and/or by irreversibly destroying components of the at least one line. An interlocking and/or force-fitted connection is produced, for example, by a combination of plug connectors and/or by a threaded connection.

Because the pivoting range of the at least one common support 108 or support frame 108 is limited to an angle of preferably less than 360°, more preferably less than 180° and more preferably still less than 80°, a rotating union is not necessary, and more particularly, no such union that would permit full revolutions or more. This reduces structural expense and is associated with decreased costs, in terms of both purchasing and operation, over a rotary connection. More particularly, the difficulties that arise in connection with the wear and tear on sliding contacts or losses from inductive transmissions in the case of power supply lines, or that arise in connection with leaks and/or wear and tear on rotating unions in the case of fluid lines, are eliminated. In the simplest case, the at least one line is at least one cable and/or at least one hose, which is rigidly connected at its first end to a component that is arranged fixedly in relation to the frame 112 of the roll unwinding device 100, and which is rigidly connected at its second end to a component that is arranged fixedly in relation to the at least one common support 108 or support frame 108. A cable can comprise a plurality of cable sections that are connected by plug-type connections and/or threaded connections, for example. A hose can comprise a plurality of hose sections that are connected via threaded connections and/or plug-type connections, for example.

The tubular component 131 preferably has a plurality of sections. A preferred first section is bent by an angle of at least 30° and at most 150°, more preferably at least 70° and at most 110°. The at least one line is conducted through the first section around a curve in a defined manner, before said line passes through the bearing 129. Mechanical wear and tear on the at least one line is thereby reduced. The first section preferably has an inlet opening, through which the at least one line is fed to the tubular component 131. The first section is located on a side of the frame 112 that faces away from the common support 108 or support frame 108. Further preferably, a second section is attached to the first section. The second section preferably extends parallel and more preferably coaxially to the pivot axis 109 of the at least one common support 108 or support frame 108. The second section preferably extends through the bearing 129. The second section preferably extends through the bearing 129. The second section preferably extends from a side of the frame 112 that faces away from the common support 108 or support frame 108, up to a region inside the frame 112 of the roll unwinding device 100. A third section is preferably attached to the second section. The third section has at least one curve and preferably two curves, each having an angle of preferably at least 10° and at most 100°, and more preferably at least 20° and at most 60°. The at least one line is conducted through the third section away from the pivot axis 109 and up to the drive motor 104 of the at least one roll holding device 103 or to another component arranged rigidly in relation to the at least one common support 108 and/or support frame 108. A defined position of the at least one line relative to the drive motor 104 and/or relative to the other component which is arranged rigidly in relation to the at least one common support 108 or support frame 108 is thereby established, permanently and independently of the pivot position of the at least one common support 108 or support frame 108. The first section and/or the third section preferably have a mounting 138, which can be embodied, for example, as a support 138, and which forms a rigid position of the first and/or third sections of the tubular component 131 relative to the at least one common support 108 or support frame 108. The third section, and therefore the entire tubular component 131, preferably ends at a maximum distance of 50 cm from the drive motor 104.

A second variant of the roll unwinding device 100, in which two chucking mandrels 103 or clamping mandrels 103 are provided for each storage position, will be described in the following. However, all specifications may also be transferred generally to the at least one roll holding device 103, as long as no incompatibilities exist. To allow a printing material roll 101 to be loaded onto the at least one roll holding device 103, in the case of chucking mandrels 103 or clamping mandrels 103, at least one of the chucking mandrels 103 or clamping mandrels 103, and preferably both chucking mandrels 103 or clamping mandrels 103, are displaceable in and/or counter to the axial direction A. This axial direction A is aligned parallel to the rotational axis 111 of the printing material roll 101 and optionally parallel to the pivot axis 109 of the at least one common support 108 or support frame 108 of the roll unwinding device 100. This means that the axial direction A is likewise a direction A along the width of the printing material web 02. When the printing material roll 101 is in a loaded state, the rotational axis 111 of the printing material roll 101 is also the rotational axis 111 of the chucking mandrels 103 or clamping mandrels 103 that are in contact with said printing material roll 101. In the case of chucking mandrels 103, the chucking mandrels 103 preferably each have at least two carrier elements, preferably embodied as clamping jaws. The chucking mandrels 103 further each have a supporting journal, to which the carrier elements preferably embodied as clamping jaws are preferably movably connected. The positions of the carrier elements preferably embodied as clamping jaws are adjustable, at least in a radial direction with respect to a rotational axis 111 of the chucking mandrels 103, which axis coincides with the rotational axis 111 of the printing material roll 101. When the carrier elements preferably embodied as clamping jaws are in a freely operating state, all the components of the carrier elements preferably embodied as clamping jaws lie within a radius defined by a maximum radial dimension of the supporting journal. When the carrier elements preferably embodied as clamping jaws are in a clamped operating state, parts of the carrier elements preferably embodied as clamping jaws lie outside of this radius defined by the maximum radial dimension of the supporting journal.

Regardless of whether the roll unwinding device 100 is in the first or the second variant, the roll unwinding device 100 preferably further comprises the frame 112 that supports the at least one common support 108 or support frame 108 via bearings 129. Along a transport path of a printing material web 02 downstream of the roll holding device 103, the roll unwinding device 100 preferably has a dancer roller 113 arranged on a dancer lever 121, and/or a web edge aligner 114 and/or an infeed nip 119 formed by a traction roller 118 and a traction impression roller 117 and an infeed unit 139 having a measuring roller 141 embodied as an infeed measuring roller 141. This traction roller 118 preferably has an integral drive motor 146, embodied as a traction drive motor 146, which is preferably connected to a machine controller. A web tension can be adjusted and can be held within limits and/or the web tension is preferably held within limits by means of the dancer roller 113, which is preferably displaceably disposed on a dancer lever 121. The dancer roller 113 is preferably used to compensate for inconsistencies in web tension, for example, in the case of printing material rolls 101 running out of round. The roll unwinding device 100 optionally has a splicing and cutting unit, which can be used to implement a flying roll change, i.e., without stopping movement of the printing material web 02.

The roll unwinding device 100 preferably has the web edge aligner 114, which is also called a web aligner 114. This web edge aligner 114 is preferably a first web edge aligner 114. This web edge aligner 114 is preferably arranged upstream of the at least one first printing unit 200 with respect to the transport path of the printing material web 02. This web edge aligner 114 has at least two alignment rollers 116, aligned at least substantially and preferably precisely parallel to one another, around which the printing material web 02 wraps during printing operation, and the rotational axes of which can be adjusted individually and/or together in terms of their respective angular position in space and/or in relation to a direction of transport of the printing material web 02. The two alignment rollers 116 are preferably arranged on a frame and can pivot together about a pivot axis, which is oriented perpendicular to a plane that contains the rotational axes of the alignment rollers 116. The web edge aligner 114 is used to align the printing material web 02 in terms of its lateral position, that is, the position of the edges of said web is aligned with respect to the direction A along the width of the printing material web 02, which lies orthogonally to the direction of transport of the printing material web 02. In this process, the at least two alignment rollers 116 are aligned on the basis of measurement signals from at least one sensor such that the position of the printing material web 02 wrapping around the alignment rollers 116 can be adjusted very quickly with respect to the direction extending orthogonally to the direction of transport of the printing material web 02. For longer-term, tendential alignments of the printing material web 02, the entire printing material roll 101 is preferably moved in the direction A of its rotational axis 111. For a better utilization of space, for example, the web edge aligner 114 is preferably arranged above the supporting arms 107 of the roll unwinding device 100.

An infeed unit 139 is preferably arranged downstream of the web edge aligner 114. At least the traction roller 118 is preferably provided as a component of the infeed unit 139, with the traction impression roller 117 preferably being arranged so as to interact with said traction roller. The traction roller 118 and the traction impression roller 117 preferably form an infeed nip 119, into which the printing material web 02 is clamped or can be clamped, and through which the printing material web 02 is preferably conveyed. However, the traction roller 118 can also be embodied as a suction roller, for example. The infeed nip 119 serves to adjust a web tension and/or to transport the printing material 02. The traction impression roller 117 preferably has an outer surface made of an elastic material, for example, an elastomer. The measuring roller 141 embodied as an infeed measuring roller 141 is preferably provided, by means of which a web tension can be measured. The results of these measurements are preferably used as a basis for adjusting web tension. The at least one measuring roller 141 is preferably situated upstream of the infeed nip 119 in the direction of transport of the printing material web 02. In one variant, the traction impression roller 117 has at least one carrier, which in the case of a printing material 02 embodied as a textile web 02, improves the transport of the printing material 02. To improve the utilization of space, for example, the infeed unit 139 is preferably situated above the supporting arms 107 of the roll unwinding device 100, and more preferably at the same height as the web edge aligner 114.

A first printing unit 200 is preferably situated downstream of the roll unwinding device 100 with respect to the transport path of the printing material web 02. The first printing unit 200 preferably has at least one first central printing cylinder 201, or central cylinder 201. During printing operation, the printing material web 02 preferably wraps at least partially around the first central cylinder 201. In this case, the wrap angle preferably measures at least 180° and more preferably at least 270°. The wrap angle in this case is the angle, measured in the circumferential direction, of an outer cylinder surface of the first central cylinder 201 along which the printing material 02 and particularly the printing material web 02 is in contact with the first central cylinder 201.

At least one first printing element 211 is preferably arranged in the first printing unit 200. The at least one first printing element 211 is preferably arranged downstream of a first cylinder, embodied as the first impression roller 206, in the direction of rotation of the first central cylinder 201 and therefore along the transport path of the printing material web 02, aligned toward the at least one first central cylinder 201. The at least one first printing element 211 is preferably embodied as a first inkjet printing element 211, and is also called the first inkjet printing element 211 The first printing element 211 preferably has at least one nozzle bar 213 and preferably a plurality of nozzle bars 213. The at least one first printing element 211 and therefore the at least one first printing unit 200 has at least one first print head 212, embodied as an inkjet print head 212. The at least one nozzle bar 213 preferably has at least one and preferably a plurality of print heads 212. Each print head 212 preferably has a plurality of nozzles, from which droplets of printing ink are ejected and/or can be ejected. A nozzle bar 213 in this context is a component which preferably extends across at least 80% and more preferably at least 100% of the width of the printing material web 02 and/or the axial length of the body of the at least one first central cylinder 201, and serves as a support for the at least one print head 212. In this case, a single nozzle bar 213 or a plurality of nozzle bars is provided per printing element 211. A clearly defined target region, referred to the direction A along the width of the printing material web 02 and therefore to the direction A of the rotational axis 207 of the at least one first central cylinder 201, is dedicated to each nozzle. Each target region of a nozzle, particularly referred to the circumferential direction of the at least one first central cylinder 201, is clearly defined.

The alignment of the printing material web 02 by means of the web edge aligner 114, and optionally the first impression roller 206 of the first printing unit 200, and the large wrap angle of the printing material web 02 around the at least one first central cylinder 201, and optionally additional devices serve to ensure that the printing material web 02 is arranged without slip in a precisely defined position on the outer cylinder surface of the at least one first central cylinder 201, and remains in said position up to a selective release at the end of the region of the wrap angle.

Once the printing material web 02 has passed through the at least one first printing unit 200, the printing material web 02 is further transported along its transport path, and is preferably fed to the at least one first dryer 301 of the at least one dryer unit 300.

The invention claimed is:

1. A roll unwinding device for a web-fed printing machine, the roll unwinding device including a frame, at least one roll holding device supported by the frame and embodied as a clamping shaft having a rotational axis and with at least one carrier element connected to the clamping shaft for movement in a radial direction with respect to the rotational axis and at least one drive motor connected to the clamping shaft by at least one torque transfer element, the roll unwinding device further having at least two clamping shaft bearings, at least one of the clamping shaft bearings being connectable to the clamping shaft to transfer torque from the at least one torque transfer element to the clamping shaft, and wherein the at least one clamping shaft bearing is connected to the at least one drive motor through the at least one torque transfer device to transfer torque to the clamping shaft, the at least two clamping shaft bearings each being arranged to rotate individually at least partially with respect to the rotational axis of the clamping shaft and being able to pivot with respect to the frame of the roll unwinding device around a pivot axis that is different from the rotational axis the clamping shaft and wherein the at least two clamping shaft bearings are each embodied as a bearing cap.

2. The roll unwinding device according to claim 1, characterized in that the roll unwinding device has at least one support frame, which is arranged to pivot relative to the frame of the roll unwinding device around a pivot axis, and which support frame has two supporting arms.

3. The roll unwinding device according to claim 2, characterized in that one of the clamping shaft bearings is arranged on each one of the two supporting arms.

4. The roll unwinding device according to claim 2, characterized in that the at least one drive motor is arranged rigidly relative to the support frame to pivot together with the support frame around the pivot axis.

5. The roll unwinding device according to claim 2, characterized in that at least one pivot drive is provided and is capable of effecting a pivoting movement of the support frame relative to the frame of the roll unwinding device (100).

6. The roll unwinding device according to claim 5, characterized in that the at least one pivot drive has a torque limiter.

7. The roll unwinding device according to claim 2, characterized in that the rotational axis of the clamping shaft and a rotational axis of the drive motor are arranged separated by a plane that extends in a vertical direction and contains the pivot axis, independently of an angular position of the support frame.

8. The roll unwinding device according to claim 1, characterized in that a pivot range of the support frame around the pivot axis is limited by a pivoting range limiter to an angle that is smaller than 360°.

9. The roll unwinding device according to claim 8, characterized in that the pivot range limiter has at least one position sensor and at least one reference component.

10. The roll unwinding device according to claim 1, characterized in that the at least one torque transfer element is embodied as at least one of a traction means and at least one gear wheel.

11. The roll unwinding device according to claim 10, characterized in that the at least one traction means is embodied as at least one of a belt and a chain.

12. The roll unwinding device according to claim 1, characterized in that the at least one carrier element is movable by a pneumatic system.

13. The roll unwinding device according to claim 1, characterized in that the at least one drive motor is the sole controllable component of the roll unwinding device, whereby one of a selective acceleration and a selective deceleration of a rotation of the clamping shaft around the rotational axis can be implemented.

14. The roll unwinding device according to claim 1, characterized in that one of a dancer roller arranged on a dancer lever, and a web edge aligner, and an infeed unit having an infeed nip formed by one of a traction roller and a traction impression roller and having a measuring roller are arranged downstream of the roll holding device in a direction of transport of a printing material web.

15. The roll unwinding device according to claim 1, characterized in that the roll unwinding device has one storage position for a printing material roll.

16. The roll unwinding device according to claim 1, characterized in that the clamping shaft is a component of the roll unwinding device that is different from a core of a printing material roll.

17. The roll unwinding device according to claim 1, characterized in that the clamping shaft is in contact with a core of a printing material roll being unwound by the roll unwinding device and extends continuously through an opening in the core of the printing material roll.

18. The roll unwinding device according to claim 1, characterized in that the clamping shaft is encompassed at least partially by the at least one clamping shaft bearings in at least one radial direction with respect to the rotational axis of the clamping shaft.

19. The roll unwinding device according to claim 1, characterized in that each bearing cap has a closure element which is arranged pivotably about a closure axis.

20. The roll unwinding device according to claim 1, characterized in that the clamping shaft has at least two carrier elements, which are connected to the clamping shaft to be movable at least in a radial direction with respect to the rotational axis of the clamping shaft.

* * * * *